United States Patent [19]

Phillips et al.

[11] 3,942,488

[45] Mar. 9, 1976

[54] CAM TRANSMISSION INTERNAL COMBUSTION ENGINE

[76] Inventors: Howard L. Phillips, P.O. Box 655, Safford, Ariz. 85546; Maurice J. Moriarty, 3225 W. Suhuaro Drive, Phoenix, Ariz. 85029

[22] Filed: Apr. 8, 1974

[21] Appl. No.: 458,656

[52] U.S. Cl. ..... 123/55 AA; 123/56 C; 123/197 R

[51] Int. Cl.[2] ..... F02B 75/22

[58] Field of Search ..... 74/25; 123/44 E, 43 C, 123/44 C, 55 AA, 56 C, 197 R

[56] References Cited

UNITED STATES PATENTS

| | | | |
|---|---|---|---|
| 717,445 | 12/1902 | Nestius | 123/55 AA |
| 1,095,074 | 4/1914 | Blayney | 123/197 R |
| 1,544,482 | 6/1925 | Reineke | 123/197 R |
| 1,817,375 | 8/1931 | Imblum | 123/55 AA |
| 1,827,094 | 10/1931 | McCann | 123/44 E |
| 1,853,563 | 4/1932 | Hungerford et al. | 123/44 E |

FOREIGN PATENTS OR APPLICATIONS

| | | | |
|---|---|---|---|
| 239,818 | 3/1946 | Switzerland | 91/491 |

*Primary Examiner*—Charles J. Myhre
*Assistant Examiner*—William C. Anderson
*Attorney, Agent, or Firm*—Don J. Flickinger

[57] ABSTRACT

A power shaft is journalled within a stationary housing having a cylinder formed therein. The axis of the cylinder is radial to the axis of the power shaft. A lever arm pivotally carried by the housing is linked by a connecting rod to a piston slidably disposed within the cylinder. A crankplate rotatable with the power shaft supports a cam follower which intermittently interacts with the camming surface on the lever arm to urge the piston through the intake and compression cycles. During the power stroke of the piston, the lever arm pushes against the cam follower, causing rotation of the crankplate. In an alternate embodiment, a wrist pin having a radially extending rod is rotatably carried by the crankplate. Gear means provide timed rotation of the rod to periodically contact and interact with the piston. Either embodiment may include a plurality of radially spaced pistons and additional respective cam followers or wrist pins. Each cam follower or wrist pin may receive several power impulses per revolution.

2 Claims, 14 Drawing Figures

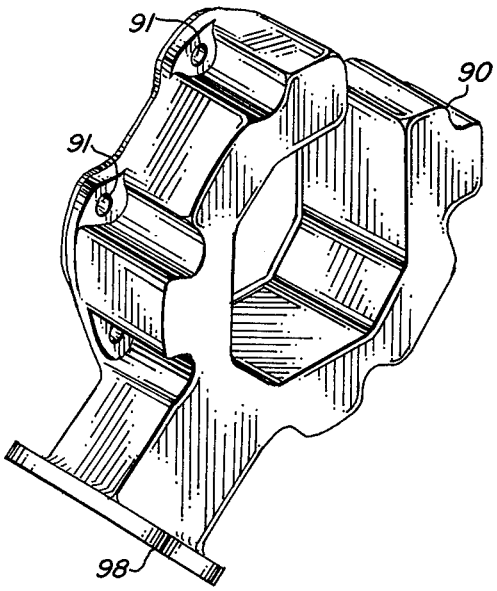
Fig-2
Fig-3
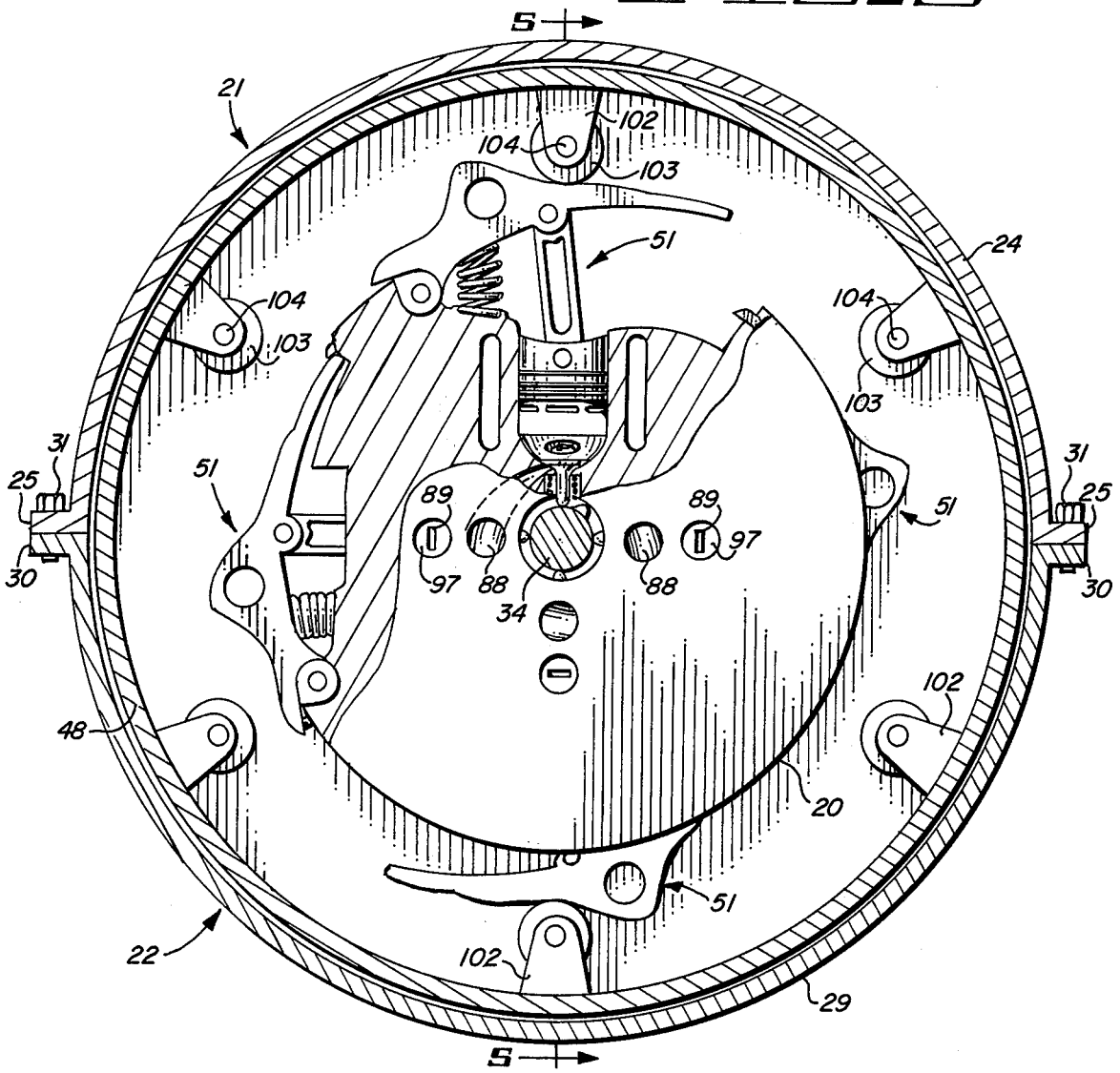

B
B
278
208
220
227
221
228
263
267
269
267
224
229
259
217
203
278
213
230
204
231
209
201
205
210
202
211
210
210
250

CAM TRANSMISSION INTERNAL COMBUSTION ENGINE

This invention relates to internal combustion engines.

In a further aspect, the invention relates to internal combustion engines of the type having reciprocating pistons which impart rotary motion to a power output shaft.

More particularly, the present invention concerns an engine having radially disposed pistons which intermittently communicate with a power output shaft.

The standard power plant for conventional self-propelled vehicles is the well-known Otto cycle internal combustion engine. Generally, the engine consists of a stationary cylinder and a single acting piston, which taken together form a combustion chamber of variable size. As the piston moves within the chamber in response to the expanding gases of combustion, rotary motion is imparted to a crankshaft through a connecting rod. One end of the connecting rod is affixed to a wrist pin pivotally secured to the piston, while the other end thereof is rotatably journalled about an offset throw of the crankshaft.

Since ignition within the combustion chamber is periodic, the power output tends to be cyclic. It is usual, therefore, to build internal combustion engines of more than one cylinder to overlap power pulses and obtain a more uniform delivery of output power. The more common multi-cylinder arrangements are four, size or eight cylinders. Proportionately, the crankshaft is extended to include an additional offset throw to accommodate each piston connecting rod.

The power developed by the internal combustion engine is closely related to the speed of the engine. The greater the speed, the greater the number of power pulses in a unit of time. Conventionally, the speed and the power are varied by the quantity-governing system. In quantity governing, the fuel-to-air mixture ratio remaining constant, but the quantity of mixture fed per cycle is varied in accordance with the desired output. The quantity is governed by the throttle valve of the carburetor as operated by the driver of the vehicle.

The internal combustion engine based upon the concept briefly described above has dominated the automotive industry for more than 60 years. Yet, the engine has numerous objectionable inherent characteristics. The engine is extremely large and heavy in relation to the power output as a result of the necessity of adding two additional cylinders to gain one power pulse per revolution of the crankshaft. To provide sufficient power and a smoothly operating engine consistent with current automotive trends, the automotive industry has standardized upon an eight cylinder engine having two opposed banks of four cylinders each. Numerous parts are required for the operation of the large engine, as motion must be transmitted from one point to another. Exemplary is the transmission of the rotary motion of the crankshaft at the bottom of the engine to reciprocating motion of the valves at the top of the engine. This includes a cam shaft driven by the crankshaft and a lifter-pushrod-rocker arm assembly to drive each of the two valves associated with each cylinder.

The engine is subject to various common failures. The length of the engine requires an extended crankshaft supported by several bearings and having an offset throw corresponding to each cylinder. The crankshaft transmits tremendous torsional forces between the instant power stroking piston and the transmission. Occasionally, the crankshaft will fail in service. The connecting rod is a familiar source of concern. One end of the connecting rod is pivotally connected to the piston and moves in simple translation with a stop and reverse motion at each end of the stroke. The other end of the connecting rod is journalled about an offset throw of the crankshaft and maintains continuous rotary motion. The crankshaft is, therefore, under considerable stress and the failure associated therewith, commonly termed "a blown engine", is well known.

Another and highly significant area of concern with the internal combustion engine is the development of power which is either adequate or appropriate to meet the immediate demand. The number of power pulses per revolution of the crankshaft is unalterable. As previously noted, the speed of the engine and the strength of the power pulse is variable by changing the quantity of fuel mixture fed into the engine. Power is nearly maximum at rated speed. However, in accordance with quantity governing, the efficiency of the engine is greatly reduced at lower speeds since the full compression pressure is not reached when the engine is operating throttled.

Considered in terms of vehicle motion, the power developed by the engine performs three basic functions — moving the vehicle from rest, maintaining cruising speed, and accelerating from a lower speed to a higher speed. The output of the engine is generally matched to the acceleration requirement. Even at rated speed, even when the engine is developing nearly maximum numbers of full power strokes per unit of time, the power is not sufficient to efficiently move the vehicle from rest. It is, therefore, necessary to provide the engine with a transmission to multiply the power output. As is well known in the art, the mechanical advantage gained by the transmission is continuously or incrementally variable to compensate for the progressively reduced mechanical advantage required as the vehicle approaches cruising speed. On the other hand, only a fraction of the potential of the engine is necessary to maintain cruising speed. Even though a high engine speed may be required during cruising, the strength of the power pulses are reduced by throttling the engine and, accordingly, operating at reduced efficiency.

The prior art is replete with proposed engines which purportedly eliminate the shortcomings of the conventional internal combustion engine. The proposed engines, however, generally achieved no commercial recognition due to inherent characteristics which provided problems of equal or greater magnitude than the problems which were solved. The turbine engine had an appreciable response lag and seemingly insurmountable heat problems. After extensive devlopment and field testing as a power plant for automobiles, the turbine engine was discarded as a feasible standard replacement for the conventional engine. One particular model of rotary engine has achieved limited commercial success. However, due to fuel consumption and sealing problems, the rotary engine has not achieved universal acceptance.

It would, therefore, be highly advantageous to provide a new engine which, while eliminating the objectionable features of the conventional internal combustion engine, would not present any unusual or insurmountable new problems.

Accordingly, it is the primary object of the present invention to provide an internal combustion engine having improved reliability and flexibility.

Another object of the invention is the provision of an internal combustion engine having components in relatively simple motion and, therefore, less subject to failure.

Yet another object of the invention is to provide an engine wherein the failure of a single piston assembly will not cause complete engine failure nor prevent the engine from running.

Still another object of the invention is to provide an internal combustion engine having an advantageous power-to-weight ratio gained by utilizing each piston to provide several power pulses per revolution of the power shaft.

Yet still another object of the invention is to provide an engine in which the power pulses per revolution, thus power output and fuel consumption, is readily alterable in accordance with demand.

A further object of the invention is to provide an internal combustion engine in which the number of pistons in operation at a given time is variable.

Yet a further object of the invention is to provide an internal combustion engine of the above type in which the pistons not providing power at a given time remain static to decrease wear and heat.

Yet a still further object of the present invention is the provision of an internal combustion engine which is readily adaptable to change the ratio between the speed of the piston and the speed of the output shaft.

Even still a further object of the present invention is to provide an engine of the above type in which the power and torque curve are readily and simply alterable.

To achieve the desired objects of the present invention in accordance with a preferred embodiment thereof, first provided is a stationary housing having a power shaft journalled for rotation therein. A cylinder is formed in the housing about a longitudinal axis which is radially perpendicular to the axis of the power shaft. The cylinder has a closed inward end and an open outward end and a piston slidably disposed therein. A drive plate carried by the power shaft and rotatable therewith supports a cam follower. As the drive plate rotates, the cam follower circles the housing to pass over the open end of the cylinder once during each revolution. A lever arm is pivotally connected at one end thereof to the stationary housing and extends circumferentially therefrom across the open end of the cylinder. A connecting rod is pivotally connected at respective ends to the piston and to the lever arm. The closed end of the cylinder is provided with the conventional elements of an internal combustion engine, including a fuel intake valve, an exhaust valve and an ignition device, such as a spark plug or glow plug.

The lever arm has a cam profile along the edge thereof which periodically interacts with the cam follower during a portion of the rotation thereof. During the first increment of contact between the cam follower and the lever arm, the cam follower pushes the lever arm toward the stationary housing, thus urging the piston into the compression stroke. A subsequent power stroke forces the lever arm outwardly to bear against the cam follower to impart rotation to the drive plate and the power shaft.

In an alternate embodiment of the invention, modified means are provided for transmitting power between the piston and the drive plate. A wrist pin, having an axis parallel to the axis of the power shaft, is journalled for rotation within the drive plate. A rod extending radially from the wrist pin and rotatable therewith periodically contacts the piston to urge the piston through the compression stroke and also receive the power from the piston during the power stroke. A circular gear fixed to the housing and a pinion gear rotatable with the wrist pin cooperate to maintain timed rotation of the rod.

The foregoing and further and more specific objects and advantages of the present invention will become readily apparent to those skilled in the art from the following detailed description of the preferred embodiments thereof, taken in conjunction with the drawings, in which:

FIG. 2 is a perspective view of an exhaust manifold useful in connection with the device of FIG. 1;

FIG. 3 is a vertical section view taken along the line 3—3 of FIG. 1 and specifically illustrating a preferred cylinder piston assembly arrangement;

Figure 1:
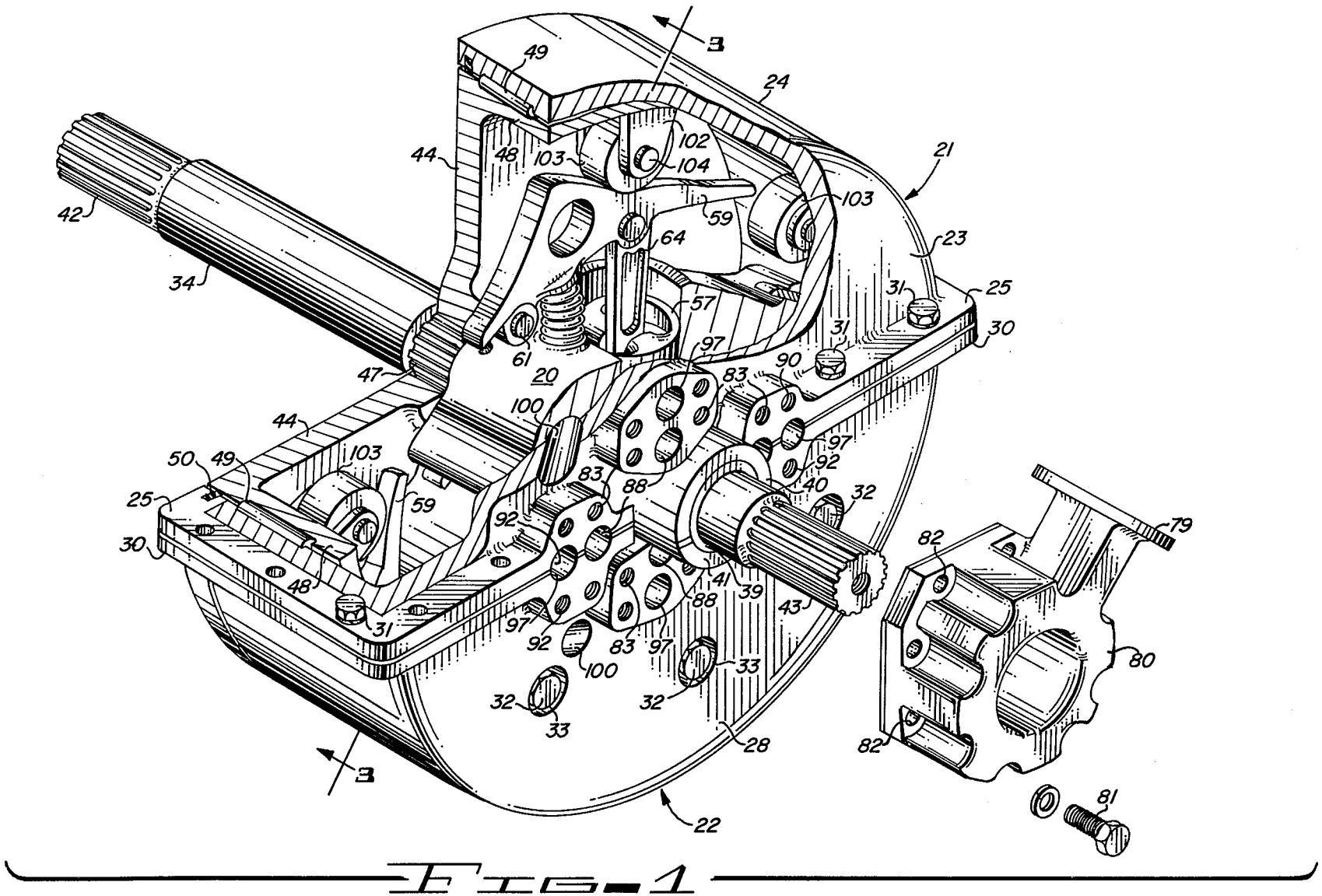
FIG. 1 is a perspective view of an internal combustion engine constructed in accordance with the teachings of the present invention, the view being partly exploded and partly broken away to better illustrate the components thereof.

Turning now to the drawings, in which the same reference numerals indicate corresponding elements throughout the several views, attention is first directed to FIG. 1, which shows an engine block 20 enclosed within a casing having an upper half 21 and a lower half 22. The upper half 21 has a vertical semi-circular front wall 23 which supports a rearwardly directed arcuate flange 24. An outwardly directed flange 25 is integral with the lower edge of the upper case half 21. The lower case half 22, being similar to the upper case half 21, has a vertical semi-circular front wall which supports a rearwardly directed arcuate flange 29. An outwardly directed flange 30 is integral with the upper edge of the lower case half 22. As illustrated, the upper case half 21 and the lower case half 22 mate to form a cylindrical casing which is secured together by a plurality of bolts 31 extending through the outwardly directed flange 25 and threadedly engaging the outwardly directed flange 30. Bolts 32, the heads of which are recessed within counterbores 33, extend through the front walls 23 and 28 and threadedly engage the engine block 20 to form a single rigid unit comprising the upper case half 21, the lower case half 22 and the engine block 20. The casing and the block, taken together, form a stationary housing. Although not herein illustrated, the housing is provided with conventional engine mounts for securing the engine to an appropriate frame.

Figure 5:
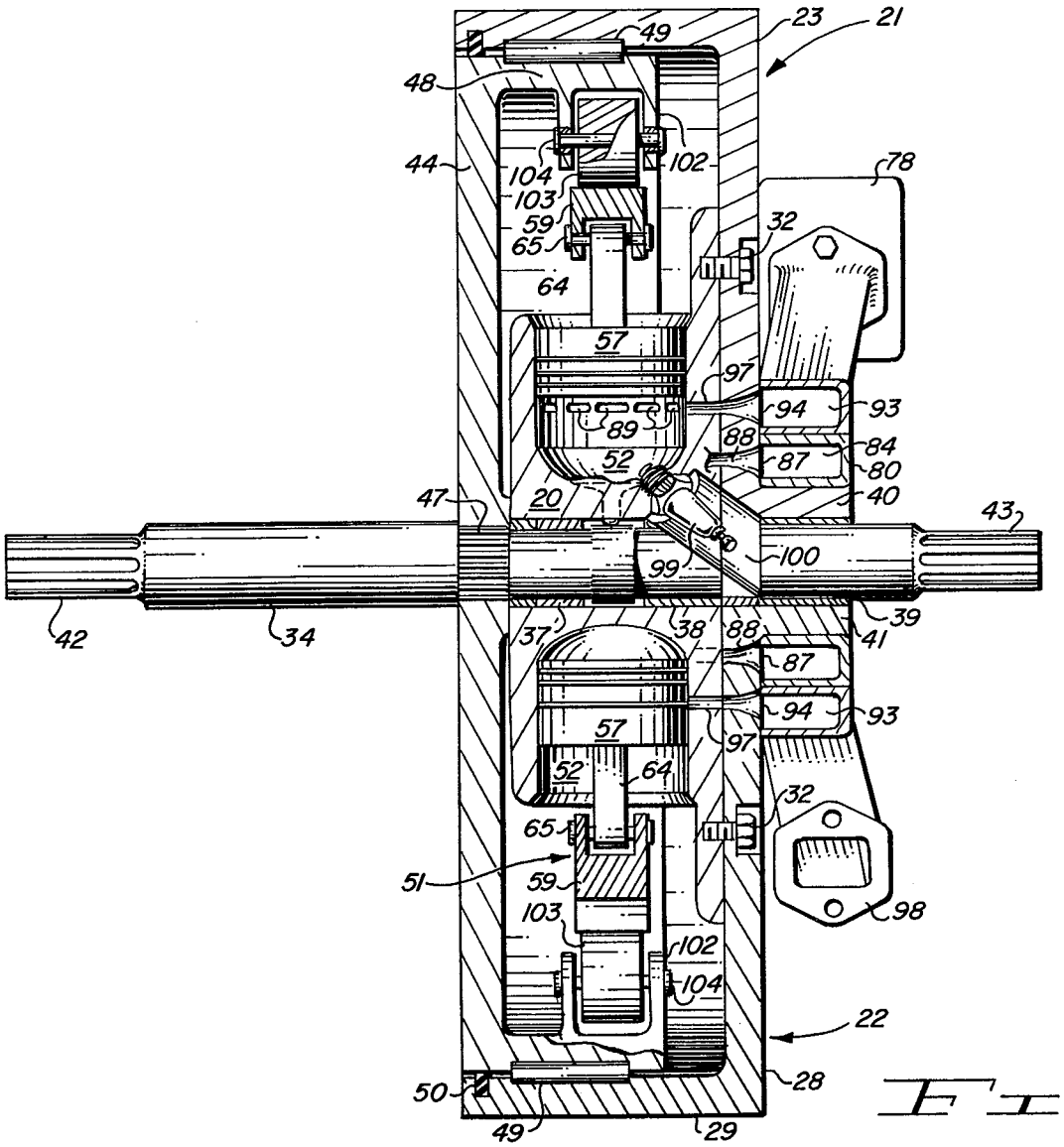
FIG. 5 is a vertical section view taken along the line 5—5 of FIG. 3.

A power shaft 34, as is also illustrated in FIG. 5, is journalled for rotation about the longitudinal axis thereof within the housing by bearings 37 and 38. An additional bearing 39 to support the power shaft 34 is carried by a hub formed by projections 40 and 41 extending from the upper case half 21 and the lower case half 22. Although herein specifically illustrated as friction bearings, it will be apparent to those skilled in the art that the bearings 37, 38 and 39 may also be anti-friction bearings, and in either case, include dynamic shaft seals to retain lubricating fluid within the engine. A power output spline 42 at the rear end of the power shaft 34 is provided for coupling the engine to the driven device. An accessory drive spline 43 at the forward end of the power shaft 34 is generally illustrative of a means by which to drive the various accessories required by an internal combustion engine. These accessories include the cooling fan, the water pump, the distributor, the generator, etc. A circular drive plate 44 is engaged by a spline 47 intermediate the ends of the power shaft 34. An inwardly directed cylindrical flange 48 is integral with the periphery of the drive plate 44. The cylindrical flange 48 is stabilized and supported against the arcuate flanges 24 and 29 by roller bearings 49. A seal 50 prevents loss of lubricating fluid in the area of the roller bearings 49. The exact function of the drive plate 44 will be hereinafter described in detail.

Referring more specifically to FIG. 3, it is seen that the engine includes four cylinder piston assemblies, as generally designated by the reference character 51. The engine of the present invention, with slight modifications, can include various numbers of cylinder piston assemblies of either two or four cycle operation, each developing one or more power pulses per revolution of the power shaft. The ensuing detailed description will be directed to an embodiment having four cylinder piston assemblies in two cycle operation which generate 24 power pulses per revolution of the power shaft. Various modifications will be described thereafter.

A cylinder 52 is formed into the engine block 20 about a longitudinal axis which is radially perpendicular to the axis of rotation of the power shaft 34. The cylinder 52 has an opened outward end 53 and a closed inward end 54. A piston 57 is slidably disposed within the cylinder. Conventional piston rings 58 carried by the piston 57 sealingly engage the wall of the cylinder 52.

A lever arm 59 has a fixed end 60 thereof which is pivotally secured to the cylinder block 20 by pin 61. The lever arm 59 extends circumferentially from the fixed end 60 across the opened end of the cylinder 52 to a free end 62. The lever arm 59 includes a cam profile 63 along substantially the length of the outboard surface thereof. A connecting rod 64 provides a link between the piston 57 and the lever arm 59. The connecting rod 64 is pivotally attached to the piston 57 by pin 65 and to the lever arm 59 by pin 66.

The closed end, or combustion chamber portion, of the cylinder 52 includes a valve 68 which seals against valve seat 69. A valve spring 70 contained within counterbore 71 and bearing against spring retainer 72 carried by the valve stem 73 retains the valve 68 in the normally closed position against the valve seat 69. A cam lobe 74 integral with the power shaft 34 periodically engages the lower end of the valve stem 73 to overcome the spring 70 and urge the valve open, as indicated by the dotted line position thereof 77. The valve 68 is the intake valve and, when in the opened position, permits communication between the interior of the cylinder 52 and the air-fuel mixing device.

For purposes of illustration, the fuel-air mixing device is herein shown as a conventional carburetor 78, it being understood that the engine is alternately operable with equivalent devices such as fuel injection and turbo-chargers. The carburetor 78 is secured in a conventional manner to the intake port pad 79 of the intake manifold 80. A plurality of bolts 81 extending through openings 82 and engaging the threaded openings 83 in the upper case half 21 and the lower case half 22 secure the intake manifold 80 to the stationary housing. The intake manifold has an opening 84 therein which is in constant communication with the carburetor 78. A plurality of ports 87 in the back side of the intake manifold extending into the opening 84 register with the intake passages 88 which extend through the housing to the cylinders 52. One passage 88 is provided for each cylinder 52.

The products of combustion are discharged through exhaust ports 89 extending through the wall of the cylinder 52. The exhaust ports 89 are normally closed by the piston 57 and are opened when the piston is near the opened end 53 of the cylinder 52. An exhaust manifold 90, shaped to be received about the intake manifold 80, is secured to the housing by bolts which extend through the openings 91 provided in the manifold and engage the threaded openings 92 in the upper and lower case halves 21 and 22, respectively. The exhaust manifold 90 has a continuous interior passage 93. Openings 94 in the back side of the exhaust manifold 90 register with exhaust passages 97 extending through the stationary housing to the exhaust ports 89. A flange 98 integral with the exhaust manifold 90 provides for the installation of a conventional exhaust pipe and muffler arrangement.

A spark plug 99 threadedly engages the engine block 20 with the tip thereof protruding into the combustion chamber portion of the cylinder 52. Access ports 100, one associated with each cylinder piston assembly 51, are sized and shaped to receive a spark plug wrench therethrough for insertion and removal of the spark plugs. The ignition system, including distributor and wiring associated with the spark plugs 99, are conventional and not herein illustrated. It is also noted that a water passage 101 extends through the block 20 forming jackets around the individual cylinders 52 and otherwise distributing coolant solution as required. Providing water cooling for an internal combustion engine is well known in the art and will not be described herein.

A plurality of lugs 102 are spaced about the interior of the flange 48. A cam follower 103, preferably of the roller type supported by axle 104, is carried by each lug 102. As the drive plate 44 rotates with the power shaft 34, each cam follower 103 sequentially and intermittently contacts each lever arm 59. During contact, the cam follower 103 interacts with the cam profile 63. During a first increment of contact, the cam follower acts upon the cam profile, whereas during a second interval of engagement, the cam profile acts upon the cam follower.

The operation of the engine is best described commencing with ignition or the beginning of the power stroke. At this instant of the cycle, the top of the piston 57 is at the position indicated by the dashed line 105. The valve 68 is closed, the exhaust ports 89 are blocked by the piston skirt, and the fuel mixture is compressed within the combustion chamber or closed end 54 of the cylinder 52. The lever arm 59 is in the dashed line position 59*a*. The cam follower 103, moving in the direction of the arrow A, has passed the apex 106 of the cam profile 63 to begin interacting with that portion of the cam profile 63 designated as segment B, which is the power generating duration.

During ignition, the spark plug 88 ignites the charge, driving the piston 57 toward the position shown in solid outline. The lever arm 59, linked to the piston 57 by the connecting rod 64, pivots about the pin 61 to return to the solid line position in response to the force upon the top of the piston. As the lever arm 59 moves upward, the cam profile 63 bears upon the cam follower 103 urging rotation in the direction of the arrow A. The power pulse is transmitted through the drive plate 44 as power input to the power shaft 34. The power stroke terminates as the piston 57 moves beyond the exhaust ports 89 and the products of combustion are discharged through the exhaust passages 97. Concurrent therewith in typical two-cycle fashion, the cam lobe 74 contacts the end of the valve stem 73, overcoming spring 70 and moving the valve 68 from seat 69 to the position indicated by the dashed line 77. Fuel mixture now enters the cylinder 52 from the intake passage 88.

The power stroke terminates with the opening of the exhaust ports 89. At this instant, the cam follower 103 is at the terminal end of the B segment of the cam profile 63 which is radially outward from the axis of the pin 61. A subsequent cam follower 103 has passed the free end 62 of the lever arm 59. Continued outward momentum of the piston 57 opens the exhaust ports 89 and brings that segment of the cam profile 63 designated as D against the subsequent cam follower 103. Thus, it is seen that instantaneously, the cam profile 63 is in contact with two cam followers 103, one at the terminal end of segment B, and the other at the initial end of the segment D. Segment D of the cam profile is shaped to interact with the cam follower 103 from the instant the exhaust ports 89 open to the end of the stroke of the piston and from there to immediately closing the exhaust ports 89. The timing of this action permits the exhaust ports 89 to remain open for a duration to allow discharge of the exhaust gas and, subsequently, close as the incoming fuel mixture reaches the exhaust ports 89. Concurrent with closing the exhaust ports 89, the subsequent cam follower 103 has moved across segment D of the cam profile 63 and is now at the initial end of the segment C. Continued movement of the cam follower 103 along segment C of cam profile 63 urges the piston 57 toward the closed end of the cylinder 52 to complete the compression stroke prior to subsequent ignition. During the foregoing-described cycle of action, the cam lobe 74 disengages the valve stem 73 to close valve 68 concurrent with piston 57 being at the terminal outward position.

The operation of each cylinder piston assembly is identical. Therefore, it is seen that in the description of the preferred embodiment as set forth above, each piston imparts one power stroke to each cam follower during each revolution of the power shaft 34. Considering six cam followers, the power shaft receives a total of 24 power pulses per revolution.

The conventional vehicle engine is required to develop maximum output generally only upon moving the vehicle from rest. The output being insufficient for the immediate task is multiplied through a transmission. An engine constructed in accordance with the teachings of the present invention provides 6 times as many power pulses per revolution of the power shaft or, alternately stated, 6 times as many power pulses per interval of time at a given speed as the conventional eight-cylinder automobile engine. The power multiplication factor is, therefore, sufficient to eliminate the transmission and couple the engine directly to the differential of the vehicle with only a clutch to disengage the engine from drive.

Figure 4:
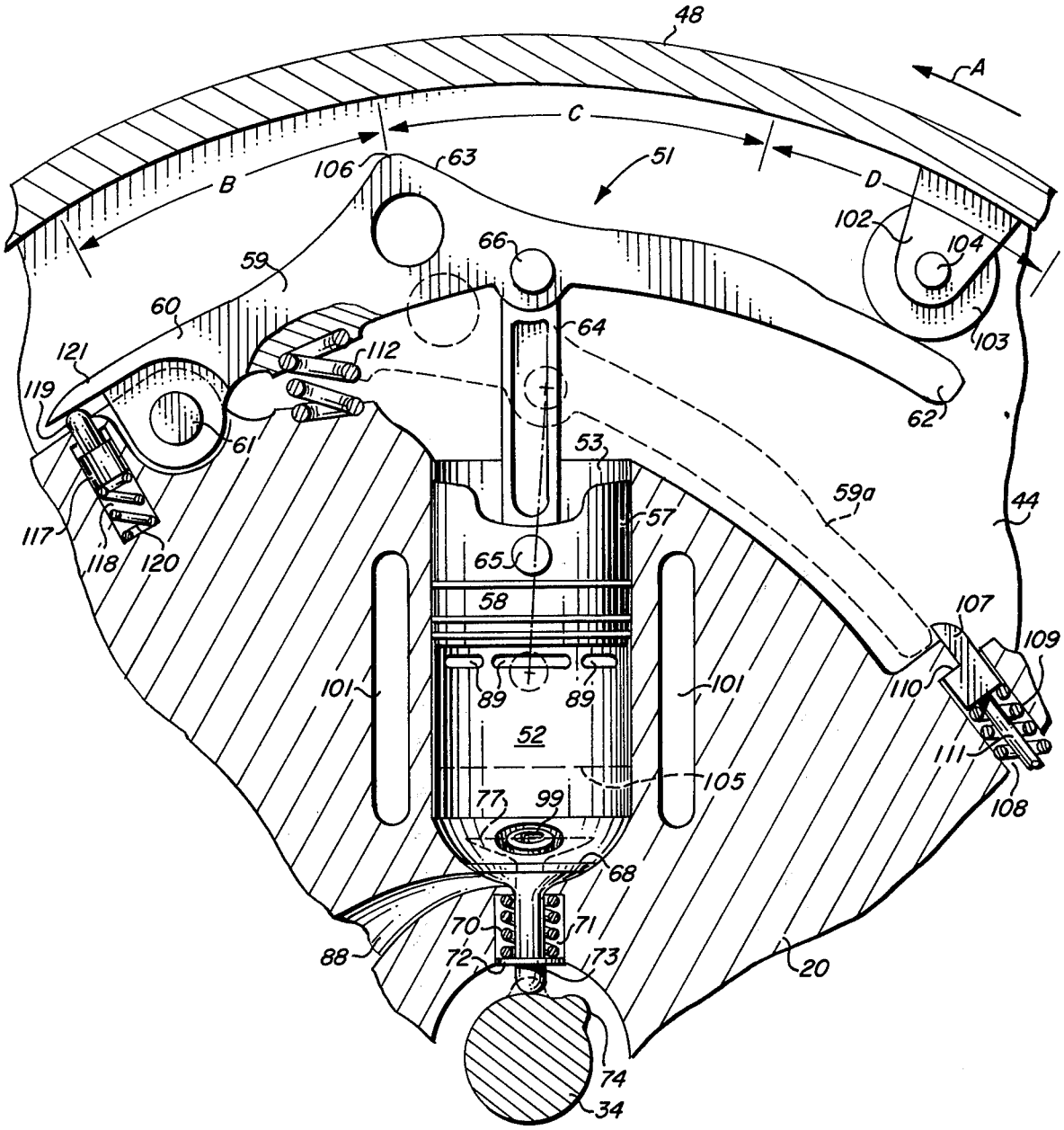
FIG. 4 is an enlarged fragmentary view corresponding to the illustration of FIG. 3 showing one of the cylinder piston arrangements thereof in greater detail.

Conversely, it is well known that the conventional eight-cylinder engine develops only a fraction of the potential thereof while maintaining a vehicle at cruising speed. The cruising speed is maintained by throttling the engine. As previously noted in connection with the discussion of quantity governing, a throttle engine is inefficient and wasteful of fuel. A more feasible solution is provided by the instant invention. Herein, those cylinder piston assemblies not needed to develop the required power output are disconnected from use, while the functioning assemblies are required to operate nearer the optimum efficiency range to provide the required output. Referring to FIG. 4, it is seen that the cylinder piston assembly 51 includes a detent 107 within a guide 108 formed in the engine block 20. A compression spring 109 normally urges the detent 107 against a stop 110. A shaft 11 operatively retracts the detent 107 from the stop 110, compressing the spring 109. Retraction of the detent 107 permits unhindered movement of the lever arm 59. The extended detent 107, as shown, engages the free end 62 of the lever arm 59 to retain the lever arm in the position indicated by the dashed line 59*a*. Although not specifically herein shown, it will be immediately apparent to those skilled in the art that the shaft 111 may be alternately connected for either manual or automatic retraction of the detent 107. The manual configuration includes linkage operable from the driver's compartment of the vehicle. Automatic operation includes a solenoid sensitive to engine demand, such as might be provided by the intake manifold vacuum. Concurrent therewith, the solenoid discontinues electrical connection to the spark plug 99. It is not necessary to disconnect the valve 68 since the stationary piston 57 creates no vacuum within the cylinder 52 which will draw fuel into the cylinder. The cylinder piston assembly 51 is returned to service by spring 112 urging the lever arm 59 outwardly after release from the detent 107.

Obviously lever arm 59 can be urged into the position indicated by dashed line 59*a* as cam power 103 passes over cam profile 63 especially apex 106. However, means are provided to immediately close exhaust ports 89 and prevent further contact between the cam power 103 and lever arm 59. The means for discontinuing sonar piston assembly 51 from service and engaging lever arm 59 under detent 107 includes a plunger 117 slidably disposed in bore 118 and normally urged against stop 119 by spring 20. A projection 121 extending from the lever arm 59 contacts the plunger 117, compressing spring 120 immediately prior to opening of the exhaust ports 89. After the piston 57 has reached the terminal outward position and exhaust gas pressure within the cylinder 52 is relieved, the spring 120 relaxes, pushing the plunger 117 against the projection 121 to rotate the lever arm 59, positioning the piston 57 to immediately close the exhaust ports 89. Further movement of the piston 57 is prohibited by the plunger 117 contacting stop 119. The cylinder piston assembly is maintained in equilibrium between the springs 120 and 112 until subsequent contact between cam follower 103 and cam profile segment C.

With minor modifications primarily in the valving, the foregoing embodiment of the invention can be altered to operate in the four-cycle mode. Herein, the closed end of the cylinder contains two valves aligned along the axis of the power shaft. The second valve is operated by an auxiliary cam lobe arrangement carried by the power shaft and spaced from the first cam lobe. The exhaust ports in the cylinder wall are eliminated and the exhaust passage through the engine block is re-routed to communicate with the second valve. The ignition sequence is also altered in accordance with four-cycle operation. Two interactions between the cam profile and the cam follower are required for each power stroke. During the first interaction, the piston moves through the compression and power cycles, while a subsequent interaction accommodates the exhaust and intake cycles.

In accordance with intended use and desired result, the operating characteristics of the engine are widely variable as a result of altering the shape of the cam profile. Various modifications along the B segment will alter the horsepower and torque curves as related to engine speed. The acceleration and deceleration curve of piston movement is similarly variable. Accompanied by appropriate valve timing, the intake and exhaust duration are extendable to increase the breathing efficiency without increasing the size of the valves or the passages.

An alternate embodiment of an internal combustion engine constructed in accordance with the teachings of the present invention is shown in FIGS. 6–10. It being understood that the immediate embodiment, similar to the embodiment hereinbefore described, is readily alterable to function either in the two-cycle or four-cycle mode, the embodiment illustrated is arranged for four-cycle operation. The embodiment includes four cylinder piston assemblies, each generating two power strokes per revolution of the crankshaft to provide a total of eight power pulses per revolution of the crankshaft.

Figure 6:
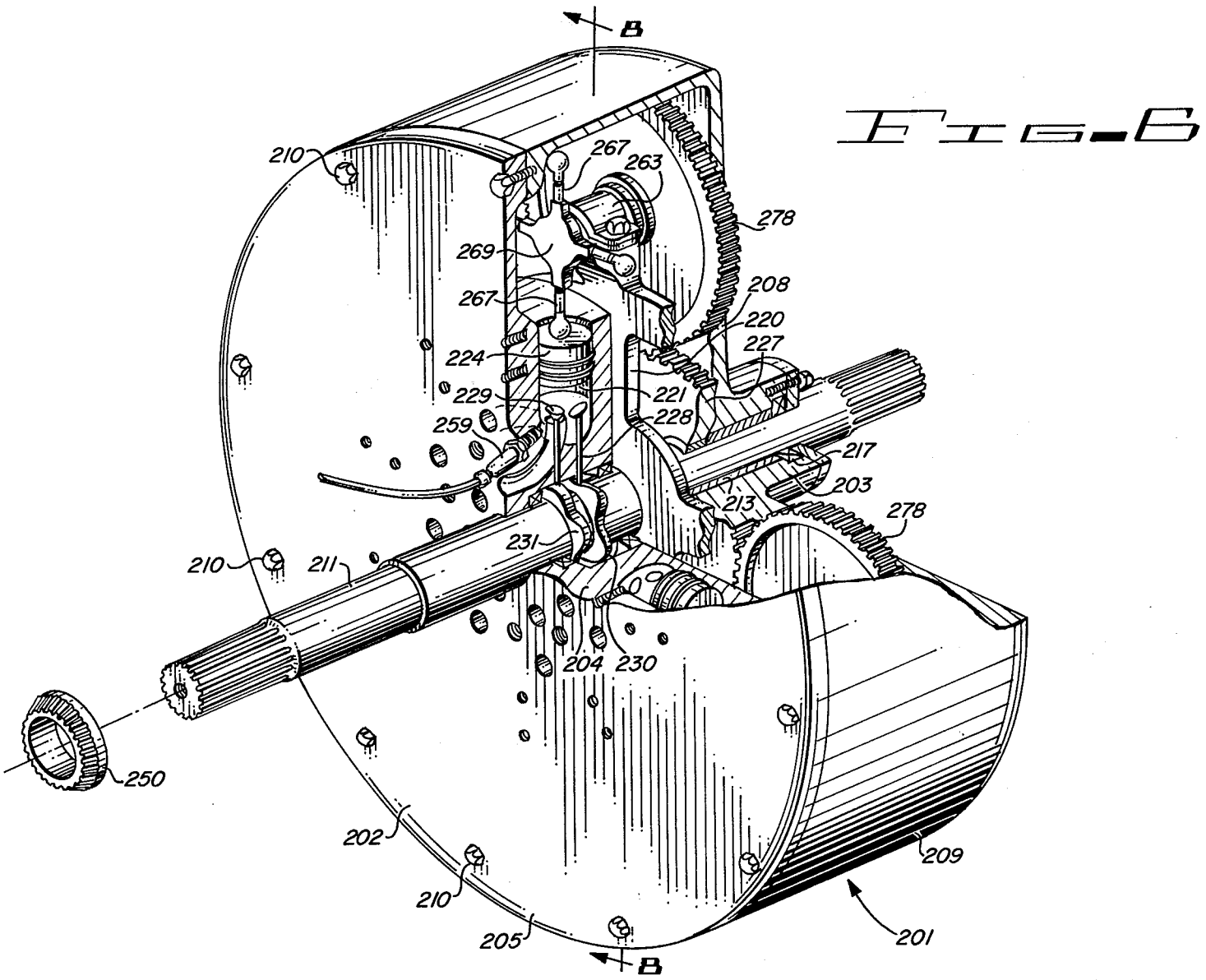
FIG. 6 is a partially broken perspective view illustrating an alternately preferred embodiment of the present invention.
Figure 7:
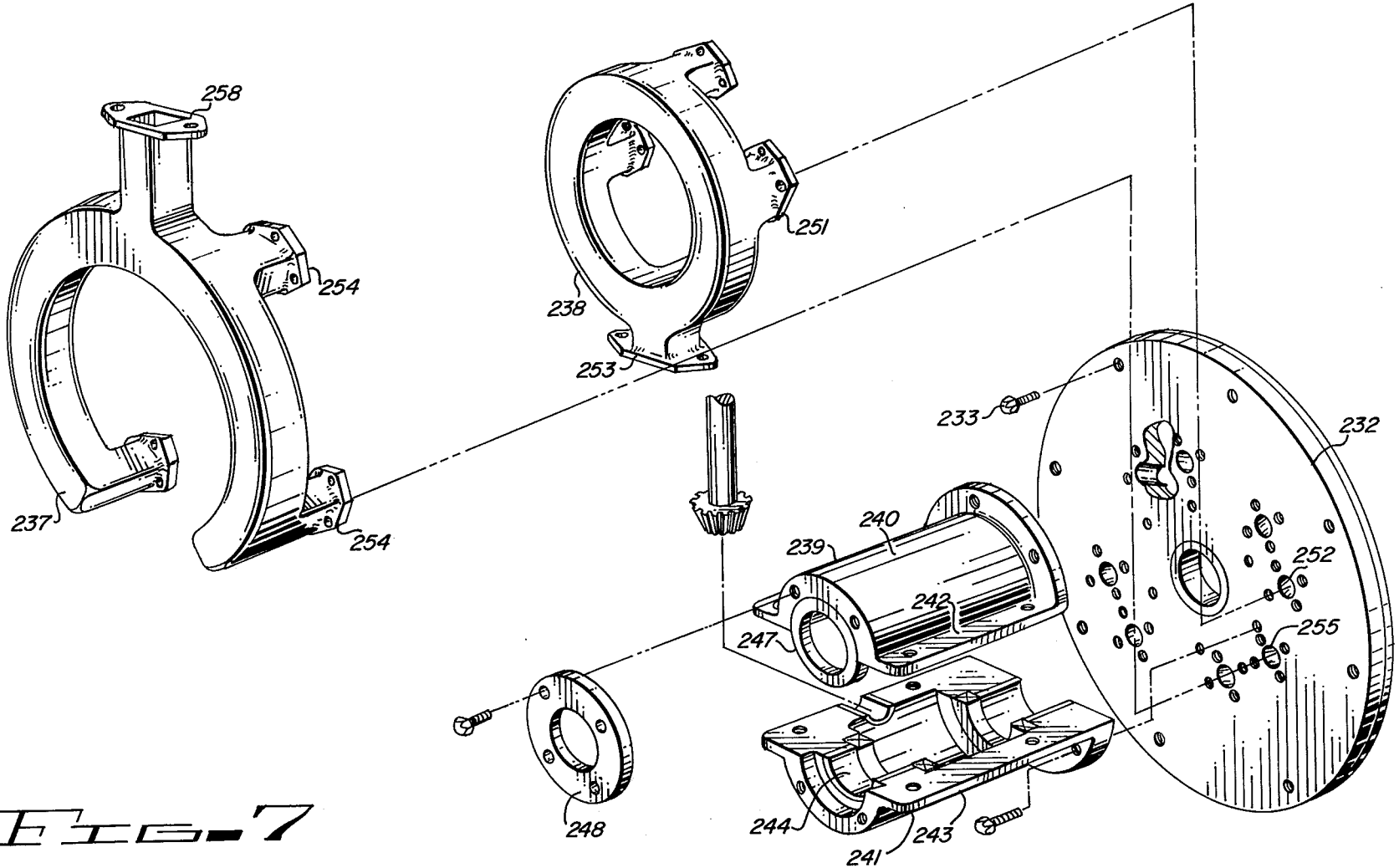
FIG. 7 is an exploded perspective view of components of the embodiment of FIG. 6 which have been removed from the front thereof as illustrated.
Figure 8:
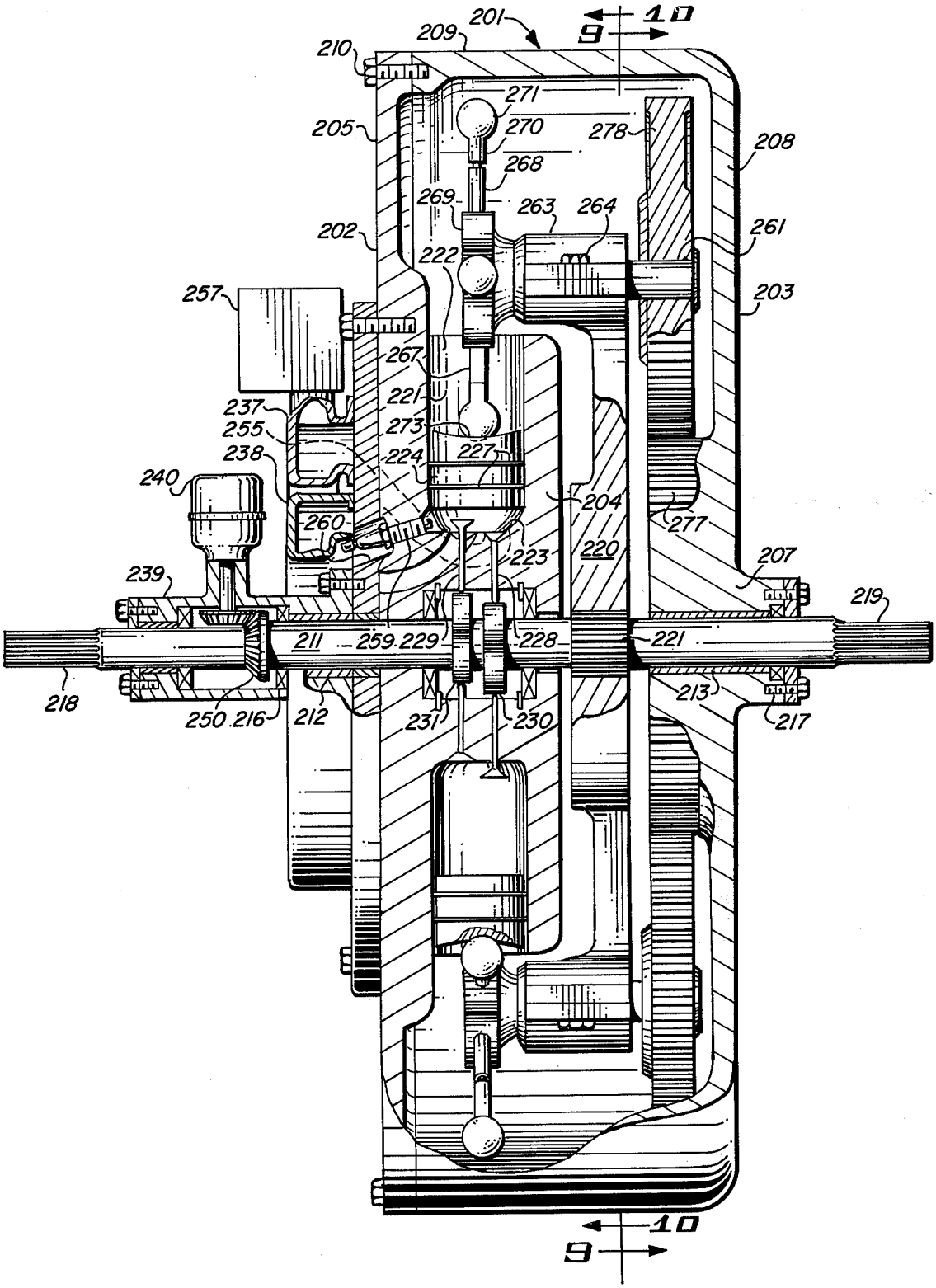
FIG. 8 is a vertical section view taken along the line 8—8 of FIG. 6 and further illustrating the components thereof.

Referring more specifically to FIGS. 6, 7 and 8, the engine is shown as having a stationary housing 201 comprising a forward case half 202 and a rear case half 203. The forward case half 202 includes an engine block section 204 and an outwardly directed flange 205. The rear case half 203 includes a hub section 207, an outwardly directed flange 208 and a forwardly directed cylindrical flange 209 integral with the periphery of the flange 208. A plurality of spaced bolts 210 extend through the flange 205 to threadedly engage the flange 209 to secure the front case half to the rear case half 203.

A power shaft 211 is journalled for rotation about the longitudinal axis thereof within the housing by bearings 212 and 213. Circular seals 216 and 217 outboard of the bearings 212 and 213, respectively, retain lubricating fluids within the housing. Spline sections 218 and 219 are integral with the forward end and rearward end of the drive shaft 211. The spline sections are representative of a power take-off attachment and an accessory drive attachment. The circular drive plate 220 is engaged by a spline 221 intermediate the ends of the power shaft 211. The function of the drive plate 220 will be described hereinafter in detail.

Four equally spaced cylinders 221 are formed into the engine block section 204. Each cylinder 221 has a longitudinal axis which is radially perpendicular to the axis of rotation of the power shaft 211. The cylinder 221 has an opened outward end 222 and a closed inward end 223 which may also be termed the combustion chamber. A piston 224 is slidably disposed within the cylinder 211. Conventional piston rings 227, carried by piston ring grooves within the piston 224, sealingly engage the wall of the cylinder 221.

An intake valve 228 and an exhaust valve 229 reside in the combustion chamber of the cylinder 221. Cam rings 230 and 231 having cam lobes thereon sequentially open the valves 228 and 229. The valve operation is conventional and the well-known valve-associated elements including springs, retainers, keepers, lifters, etc., are omitted for purposes of clarity.

A mounting plate 232 is secured to the forward case half 202 by a plurality of spaced bolts 233 which extend through the plate 232 and threadedly engage the case half 202. An intake manifold 237, an exhaust manifold 238 and a hub 239 are carried by the mounting plate 232. The cylindrical hub 239 is formed by semi-circular halves 240 and 241 bolted together along their respective flanges 242 and 243, respectively. A bearing 244 within the hub 239 gives further support to the power shaft 211. A seal 247 held by seal retainer 248 engages the power shaft 211 to maintain lubricating fluid within the hub. In accordance with conventional practice, the hub 239 supports an ignition distributor 249 driven by distributor drive gear 250 affixed to the power shaft 211.

The circular exhaust manifold 238 is sized to be mounted to the mounting plate 232 with the hub 239 extending therethrough. Rearwardly extending legs 251 of the exhaust manifold 238 register with exhaust passages 252 extending through the mounting plate 232 and the engine block 204 to the combustion chamber 233. A conventional exhaust pipe and muffler assembly is connected to the depending flanged projection 253. The circular intake manifold 237 encloses the exhaust manifold 238 and is secured to the mounting plate by rearwardly depending legs 254 over the intake passages 255 extending through the mounting plate 232 and the engine block section 204 to communicate with the combustion chamber 233 when the valve 238 is in the open position. A conventional carburetor 257 is secured to the conventional mounting flange 258. A spark plug 259 threadedly engaged within the engine block section 204 through access port 260 provides ignition for the combustion chamber 223.

Figure 10:
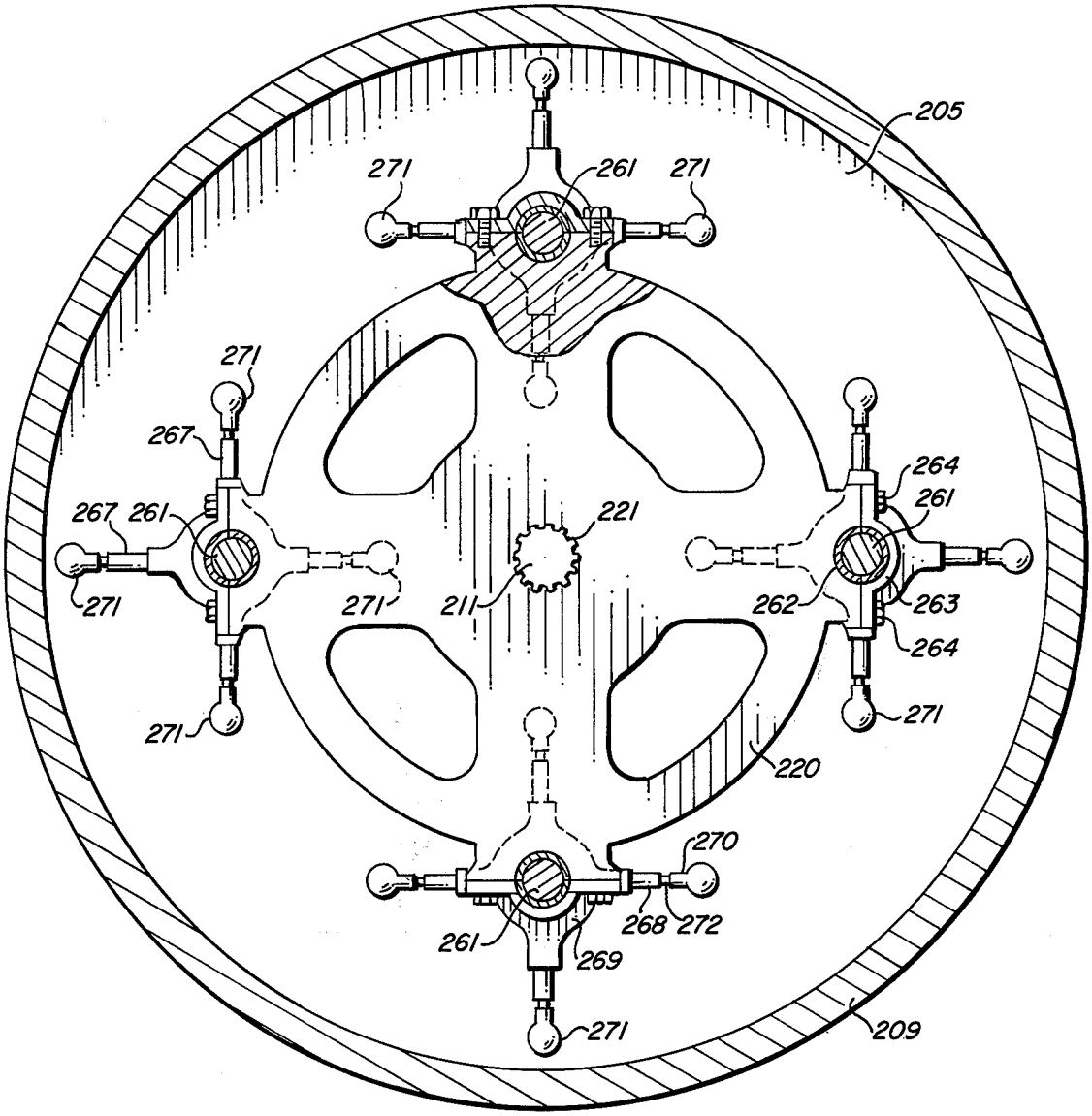
FIG. 10 is a vertical section view taken along the line 10—10 of FIG. 8.
Figure 11A:
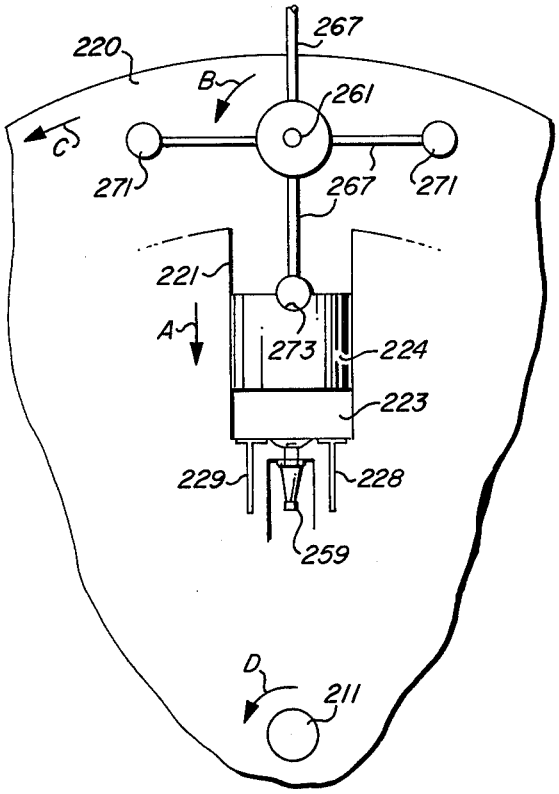
FIGS. 11*a*, 11*b*, 11*c*, 11*d* are a series of four schematic illustrations showing the power generating cycles of one piston of the embodiment of FIG. 6.
Figure 11B:
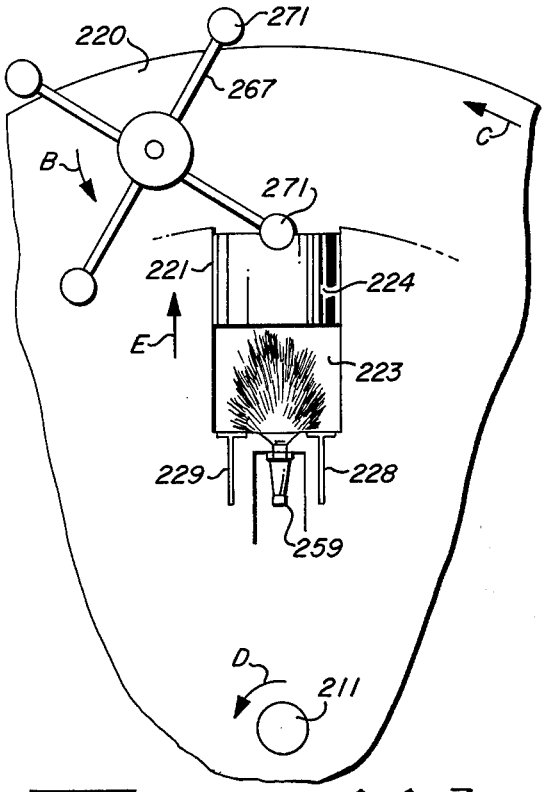
Figure 11C:
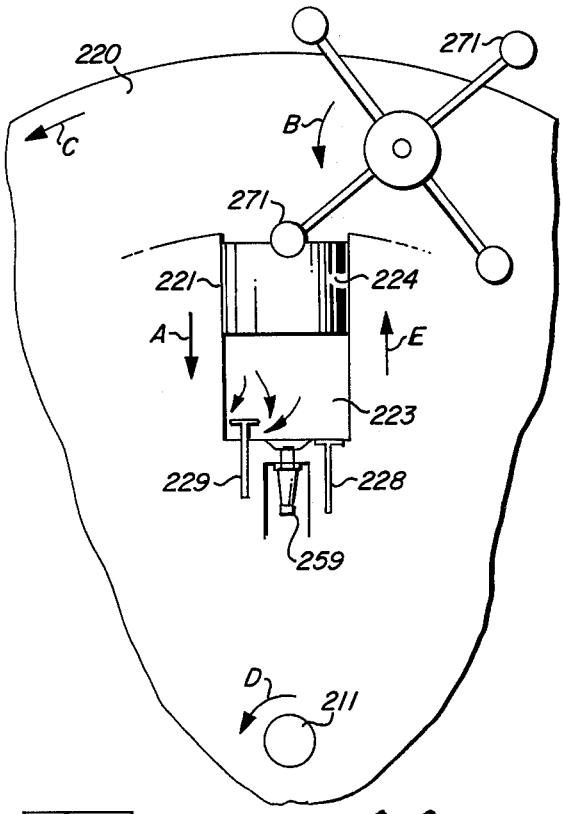
Figure 11D:
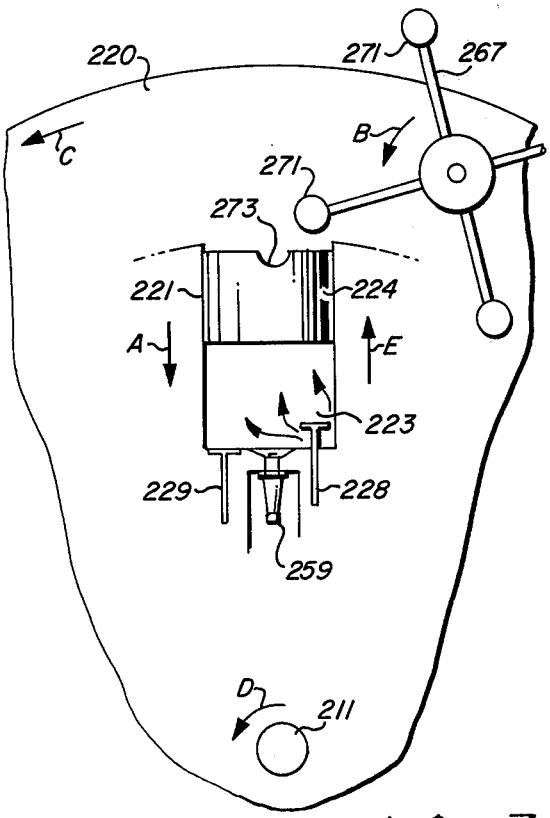

Referring more particularly to FIG. 10, the crank plate 220 supports four wrist pins 261. Each wrist pin 261 is journalled for rotation about the longitudinal axis thereof which is parallel to the axis of the drive shaft 211 within a bearing 262 retained within a pillow block-like arrangement which includes an end cap 263 and retaining bolts 264. Four equally spaced rods 267 are carried by the wrist pin 261. The longitudinal axis of each rod 267 is radial to the axis of the wrist pin 261 and lies in the plane of the axis of the cylinder 221. Each rod 267 includes an inner rod segment 268 extending from hub 269 and an outer rod segment 270 having a ball tip 271 thereon. The outer rod segment 270 has a reduced diameter portion 272 slidably received within the inner rod segment 268. Although not specifically herein illustrated, it is preferable that the receptacle within 268 which receives the reduced diameter portion 272 includes biasing means normally urging the outer segment 270 outward and dampening means to absorb shock when the outer segment 270 is thrust inward. An entirely adequate dampening means is a conventional hydraulic lifter, as is well known in the automotive valve art. A shallow socket 273 within the piston is shaped and sized to receive the ball end 271. The contracted length of the pin 267 is defined as the length thereof when the outer segment 270 is moved in the direction of the inner segment 268 to the limit of travel. At this point, the reduced diameter portion 272 will be completely within the inner segment 268 and the outer segment 270 is in contact with the inner segment 268. The contracted length of the pin 267, as illustrated in FIG. 8, is such that when the longitudinal axis of the wrist pin 261 intercepts the longitudinal axis of the cylinder 221 and the longitudinal axis of the pin 267 coincides with the longitudinal axis of the cylinder 221 with the ball end 271 received within the socket 273, the piston 224 is at the inward limit of travel.

Figure 9:
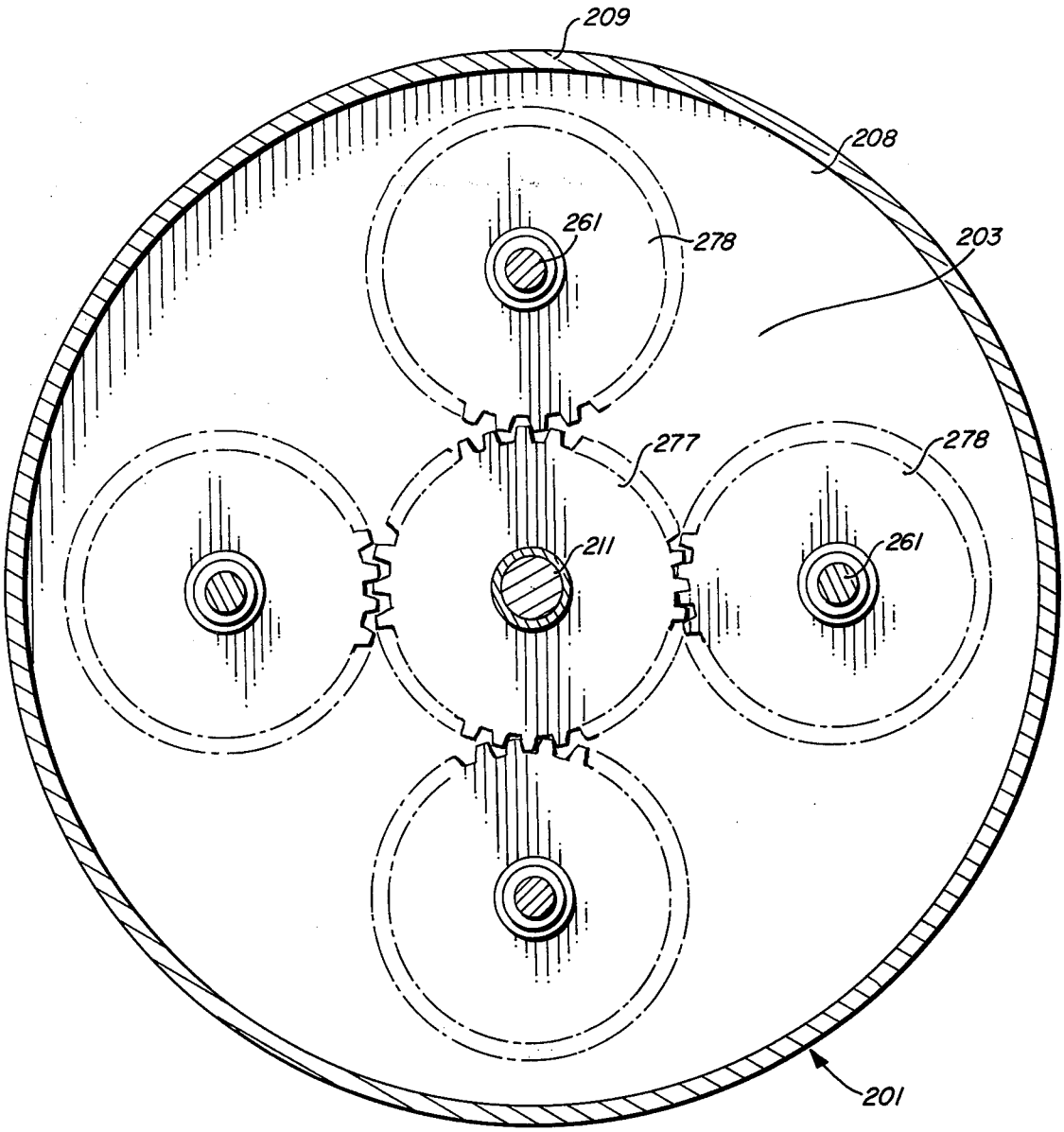
FIG. 9 is a vertical section view taken along the line 9—9 of FIG. 8.

The circular gear 277, more clearly illustrated in FIG. 9, is concentric with the power shaft 211 and fixed to housing 201. A pinion gear 278, one rotatable with each wrist pin 261, is engaged with the circular gear 277. Rotation of the pinion gear 278 during rotation of the crank plate 220 affects timed rotation of each rod 267 such that each ball end 271 thereof is sequentially received within the socket 273 of each successive piston 224.

The operation of the engine and the interaction of the elements thereof is best explained in connection with the schematic diagrams of FIG. 11. The explanation will proceed with diagram A, which shows the arrangement of elements immediately at the end of the compression stroke prior to ignition. At the instant illustrated, the longitudinal axis of the rod 267 coincides with the longitudinal axis of the cylinder 221, ball end 271 is received within socket 273, and piston 224 is at the inward limit of travel, as determined by the direction of the arrow A. The exhaust valve and the intake valve 229 and 228, respectively, are closed, retaining a charge of the fuel mixture within the combustion chamber 223. The wrist pin 261, drive plate 220 and the power shaft 221 have momentum in the direction of the respective arrows B, C and D, since the engine is in motion either under self-generated power or as a result of the action of the starter motor.

As seen in schematic B, the spark plug 259 has ignited the fuel charge within the combustion chamber 223, driving the piston 224 outward in the direction of the arrow E to the limit of its travel within the cylinder 221. The force of the piston 221 against the rod 267 forces rotation of the wrist pin 261 in the direction of the arrow B, camming the drive plate 220 in the direction of the arrow C, thereby supplying another power stroke for continued rotation of the power shaft 211 in the direction of the arrow D. The piston 224 remains at the limit of travel in the direction of arrow E until contacted by a subsequent rod 267, as noted in schematic C. Prior to contact between the ball end 271 and the socket 273, the rod 267 is in the extended position. Upon contact, the damper, as hereinbefore described, absorbs the initial shock. The exhaust valve cam 231 has rotated to open the exhaust valve 229. With continued rotation of the engine, the piston 224 is urged in the direction of the arrow A by the rod 167 exhausting the gases and particles of combustion. As the piston 224 reaches the limit of inward travel, the valve camming permits the exhaust valve 229 to close and, concurrently, opens the intake valve 228. The piston 224 then moves in the direction of the arrow E, as shown in diagram D, creating an expanding chamber into which the fuel mixture flows. Various techniques exist for causing movement of the piston 224 in the direction of the arrow E during this cycle, including spring biasing and a forced fuel charge as the result of conventional turbo-charging. The piston is retained from separating from the cylinder 221 at the limit of travel in the direction of the arrow E by various expediency, such as a snap ring contained within a groove in the cylinder wall. Concurrent with the piston 224 reaching the limit of outward travel, the intake valve 228 closes, trapping the fuel charge within the cylinder. The piston 224 remains at rest, awaiting a subsequent rod 267 to urge the piston in the direction of the arrow A to complete the cycle, as illustrated in schematic A. Timing which insures that the ball end 271 will bear against socket 273 is provided by gearing ratio between the circular gear 277 and the pinion gear 278.

From the foregoing detailed description of the embodiment illustrated in FIGS. 6–11, it is immediately apparent that with minor modifications to the valve timing and ignition timing, the engine can function on two-cycle operation. Similarly, the number of power pulses per revolution of the power shaft is alterable in accordance with the number of cylinders, rods, wrist pins and appropriate gear timing. Similar to the foregoing embodiment of FIGS. 1–5, detent means can be readily incorporated to disengage selected cylinders as desired by the operator.

Having fully described and disclosed the present invention and the preferred embodiments thereof in such clear and concise terms as to enable those skilled in the art to understand and practice the same, the invention claimed is:

1. An internal combustion engine comprising:

a. a stationary housing;

b. a power shaft journalled for rotation about the longitudinal axis thereof within said housing;

c. a cylinder formed in said housing and having a longitudinal axis radially perpendicular to the axis of said power shaft, said cylinder having a closed inward end and an open outward end;

d. a piston slidably disposed for reciprocal movement within said cylinder;

e. a drive plate carried by said power shaft;

f. a cam follower carried by said drive plate;

g. a lever arm pivotally connected at one end thereof to said stationary housing and extending circumferentially therefrom across the open end of said cylinder;

h. a cam profile carried by said lever arm for periodic interaction with said cam follower; and i. a connecting rod pivotally connected at respective ends to said piston and to said lever arm.

2. An internal combustion engine comprising:

a. a stationary housing;

b. a power shaft journalled for rotation about the longitudinal axis thereof within said housing;

c. a cylinder formed in said housing and having an axis radially perpendicular to said shaft;

d. a piston slidably disposed for limited reciprocal movement within said cylinder;

e. a drive plate carried by said power shaft and extending radially therefrom;

f. a wrist pin journalled for rotation within said drive plate and having the axis thereof parallel to said power shaft;

g. a rod extending radially from said wrist pin and rotatable therewith to periodically contact said piston and urge said piston toward said shaft;

h. a circular gear fixed to said housing concentric with said shaft; and i. a pinion gear rotatable with said wrist pin and engaged with said circular gear for timed rotation of said rod.

* * * * *